US006119966A

United States Patent [19]

Wagner et al.

[11] Patent Number: 6,119,966

[45] Date of Patent: Sep. 19, 2000

[54] FUEL INJECTION VALVE, PILOT CONTROL VALVE THEREFOR, AND METHOD FOR ITS ASSEMBLY

[75] Inventors: Werner Wagner, Gerlingen; Guenther Weissenberger, Viereth-Trunstadt; Udo Lux, Baunach; Heinz Mahr, Michelau/Schwuerbitz, all of Germany

[73] Assignee: Robert Bosch GmbH, Stuttgart, Germany

[21] Appl. No.: 09/356,034

[22] Filed: Jul. 16, 1999

[30] Foreign Application Priority Data

Jul. 21, 1998 [DE] Germany ..... 198 32 826

[51] Int. Cl.[7] ..... F02M 51/00

[52] U.S. Cl. ..... 239/585.3; 239/585.1; 251/129.15

[58] Field of Search ..... 239/88–94, 585.1, 239/585.3; 251/129.15, 129.21

[56] References Cited

U.S. PATENT DOCUMENTS

| | | | |
|---|---|---|---|
| 4,946,106 | 8/1990 | Turchi et al. . | |
| 5,901,941 | 5/1999 | Ricco | 239/585.3 X |
| 6,027,037 | 5/1999 | Murakami et al. | 239/88 |

FOREIGN PATENT DOCUMENTS

| | | |
|---|---|---|
| 0 304 744 | 12/1988 | European Pat. Off. . |
| 0 385 397 | 2/1990 | European Pat. Off. . |
| 0 450 532 A1 | 3/1991 | European Pat. Off. . |
| 483769 | 5/1992 | European Pat. Off. . |
| 0 604 913 A1 | 12/1993 | European Pat. Off. . |
| 0 604 915 A1 | 12/1993 | European Pat. Off. . |
| 37 00 687 C2 | 5/1996 | Germany . |

*Primary Examiner*—Lesley D. Morris

*Attorney, Agent, or Firm*—Ronald E. Greigg; Edwin E. Greigg

[57] ABSTRACT

A pilot control valve of a fuel injection valve, having a first housing part which forms a well with walls parallel to an axis (z-z). A second housing part with a plug-in portion which is introduced in form-locking fashion into the well up to a set-point position. The first and second housing parts jointly define a chamber in which a valve closing member is displaceable along the axis in a chamber between a closed position, in which the valve closing member rests on a pilot control valve seat, and an open position, and the stroke of the valve closing member between the closed and the open positions is defined by the set-point position. The plug-in portion is fixed in the set-point position on the walls of the well that are parallel to the axis (z-z). It is thus possible for the set-point position, which is equivalent to a desired switching performance of the pilot control valve, to be adjusted accurately before a fixation.

23 Claims, 3 Drawing Sheets

FIG. 2
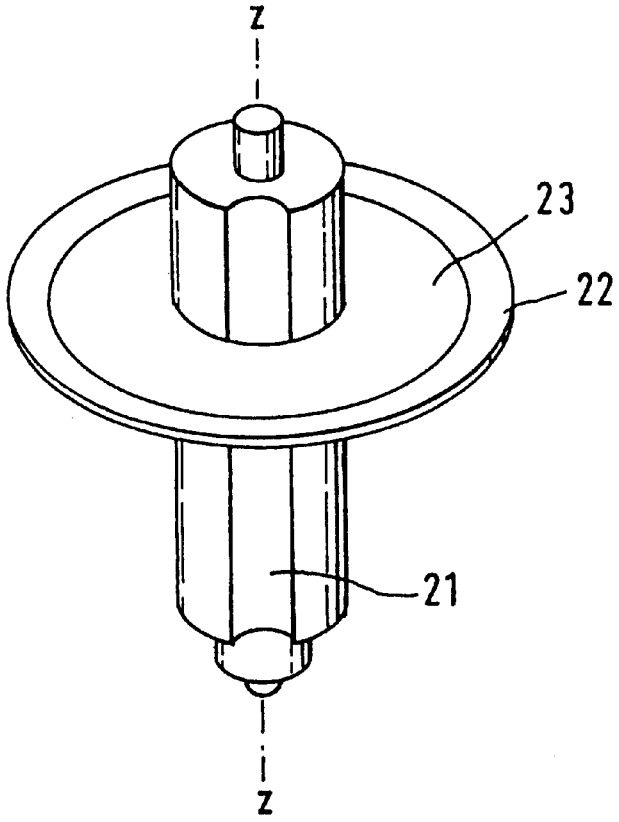
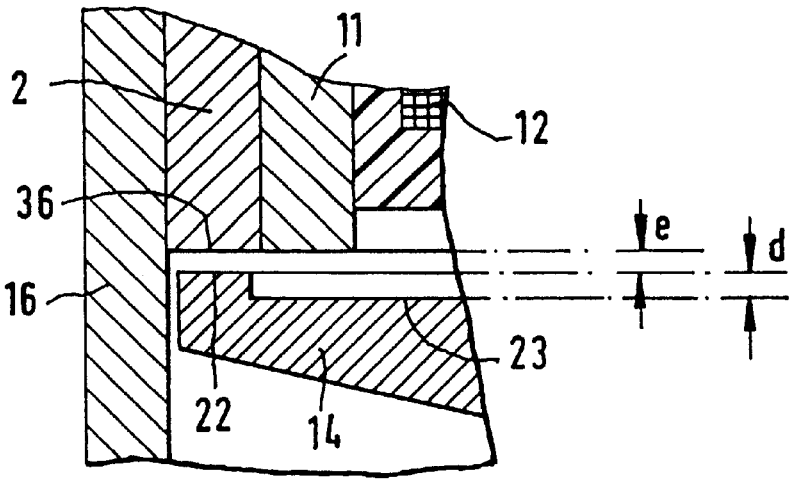
FIG. 3

FUEL INJECTION VALVE, PILOT CONTROL VALVE THEREFOR, AND METHOD FOR ITS ASSEMBLY

BACKGROUND OF THE INVENTION

The invention is based on a pilot control valve for a fuel injection valve.

Fuel injection valves conventionally have a control chamber, which communicates constantly, via a throttle, with a high-pressure fuel source. If the control pressure prevailing in the control chamber is high, then a valve member of the fuel injection valve is kept in the closing position. The control chamber can be relieved via a second throttle, which is controlled by a pilot control valve. As soon as the pilot control valve opens the second throttle, the control chamber is relieved, and the valve member changes to the opening position, so that the injection can take place. When the pilot control valve closes the second throttle again, the valve member is returned to the closing position as a result of the pressure increase in the control chamber. For the quality of fuel injection, the speed, precision and replicability of the opening and closing motions of the pilot control valve are of decisive importance.

Pilot control valves that have these properties to a satisfactory extent or that make it possible to establish them have a complicated design, comprising many parts, and thus they can be assembled and adjusted only by expending a great deal of time.

Thus the known pilot control valve shown in FIG. 4 includes two housing parts 1 and 2, of which the second part 2, is inserted into a well-like recess in the first part 1. A union nut 33 keeps the two housing parts pressed against one another in the direction of a longitudinal axis z-z of the pilot control valve. On the bottom of the recess there is a threaded bore, on the bottom of which the valve seat 3 of the pilot control valve is disposed. Via two throttles 4 and 5 and the intervening control chamber 6 of the injection valve, the valve seat communicates with an inlet neck 7 for fuel from a high-pressure pump.

A valve closing member 9 is displaceably guided by an anchor disk 8 between a closed position in which the valve closing member 9 rests on the valve seat 3, and an open position; the stroke between these two positions is determined by the thickness of a spacer disk 10, which is clamped between the bottom of the threaded bore and the anchor disk.

A magnet core 11 is let into the second housing 2; it contains a coil 12 for generating a magnetic field. In the chamber 13 defined jointly by the two housing parts 1, 2, an armature plate 14 firmly joined to the valve closing member 9 is disposed facing towards the magnet core 11. In both the open and the closed state of the pilot control valve, there should be an air gap between the armature plate and the magnet core. The width of this gap is determined by the thickness of a second spacer disk 15, which is disposed between the walls of the second housing part and the bottom of the recess in the first housing part. The spacer disk 15 bears the contact pressure of the union nut 33 and must therefore not be elastic or yielding.

It is difficult to manufacture all the parts of the known pilot control valve on a mass-production basis in such a way that the finished pilot control valves replicably have a desired switching performance. Readjusting a pilot control valve that lacks the desired switching performance is very complicated, since this requires dismantling the valve again, and the spacer disks 10, 15 might have to be replaced.

OBJECT AND SUMMARY OF THE INVENTION

The pilot control valve of the invention has the advantage over the prior art that the number of individual parts required is less, and assembly is thus simplified, and that the possibility exists of testing and optionally adjusting the pilot control valve before final assembly is done.

Because the fixation of the two housing parts to one another is done at their walls parallel to the axis, the spacer disks, whose function is merely to offer resistance to a force acting in the direction of the axis and holding the housing parts together, can be dispensed with.

Expediently, an intermediate ring can be retained between a collar of the second housing part and the edge of the well. The intermediate ring is compressible to at least a slight extent in the direction of the axis, and when the housing parts are put together it forms a stop, in whose vicinity the set-point position is located.

The fixation of the housing parts to one another can be done by methods that do not allow the housing parts to be separated from one another again, such as caulking, laser welding, induction welding, and so forth.

The construction becomes simplified in particular if the valve seat is disposed in the bottom of a blind bore, whose inner walls guide the closing element in its displacement substantially without play. In that case, it is expedient if the closing element, on its jacket surface, has at least one axially extending flat face or groove, which forms a channel for carrying fuel from the valve seat in the direction of an outlet of the pilot control valve.

A spiral spring for urging the closing element in the closing direction is advantageously fastened axially in a bore of the second housing part between the closing element and an abutment. The abutment is preferably formed by a sleeve introduced in form-locking fashion into the bore and axially fixed to the inner walls of the bore.

The fixation of the sleeve can also be done by caulking, laser welding, induction welding, and so forth; it is expedient if to that end the bore is lengthened by a pipe neck, and if the axial fixation of the sleeve is done at the level of the pipe neck.

For the sake of exact definition of the air gap between a magnet core, which is let into the housing part, and an armature plate solidly joined to the closing element, it is especially advantageous that a part of the armature plate is opposite not the magnet core but rather a portion of the second housing part, and that this portion and the armature plate are shaped to keep an air gap between the magnet core and armature plate open when the portion comes into contact with the armature plate. To this end, the portion can protrude past the surface of the magnet core facing toward the armature plate, or conversely, the armature plate can have a region protruding opposite that portion. Preferably, the portion annularly surrounds the magnet core.

The invention will be better understood and further objects and advantages thereof will become more apparent from the ensuing detailed description of preferred embodiments taken in conjunction with the drawing.

BRIEF DESCRIPTION OF THE DRAWINGS

FIG. 2 is a perspective view of the valve closing member of the pilot control valve of FIG. 1;

FIG. 3 shows an enlarged detail of FIG. 1; and

DESCRIPTION OF THE PREFERRED EMBODIMENTS

Figure 1:
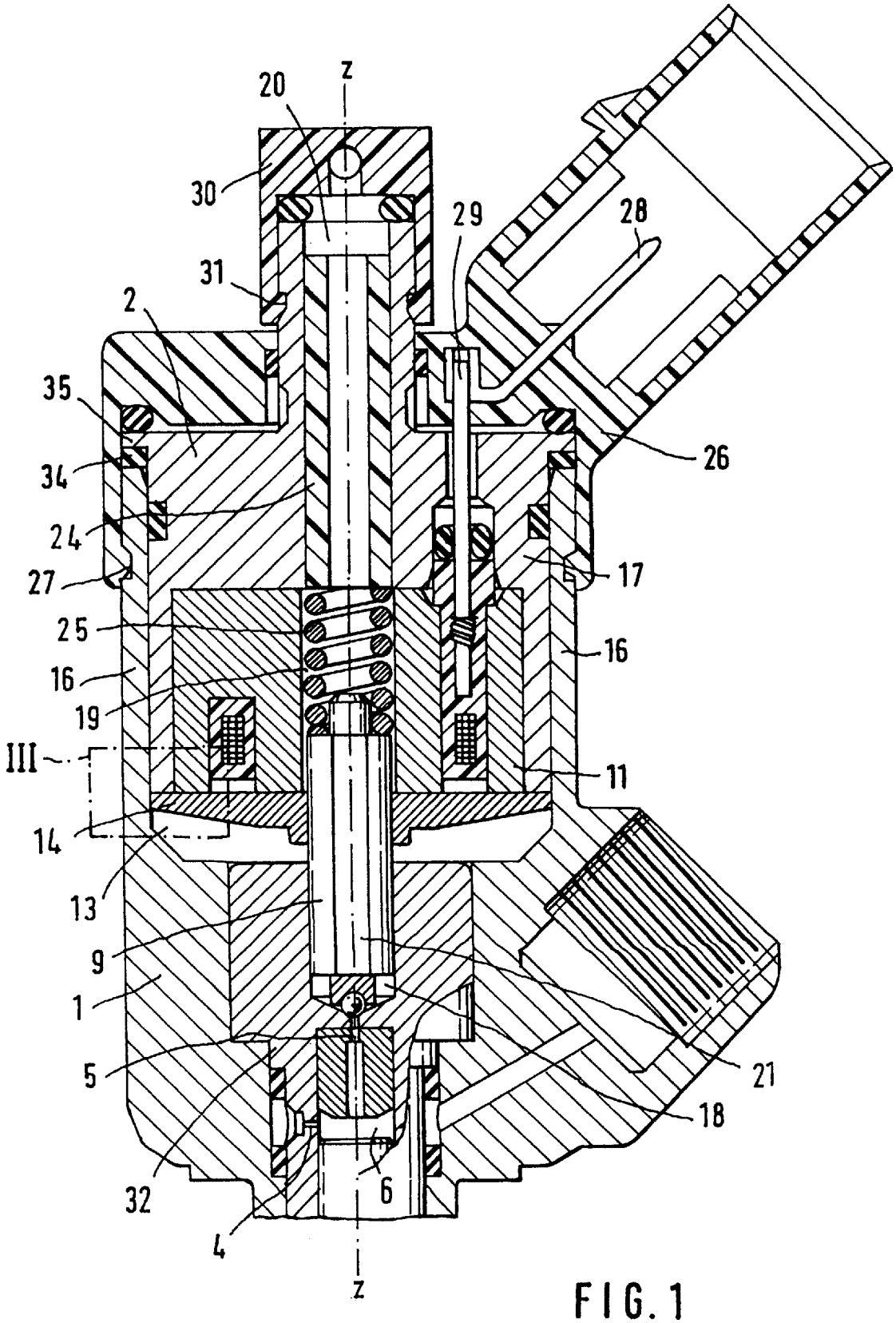
FIG. 1 is an axial section through a pilot control valve of the invention.
Figure 4:
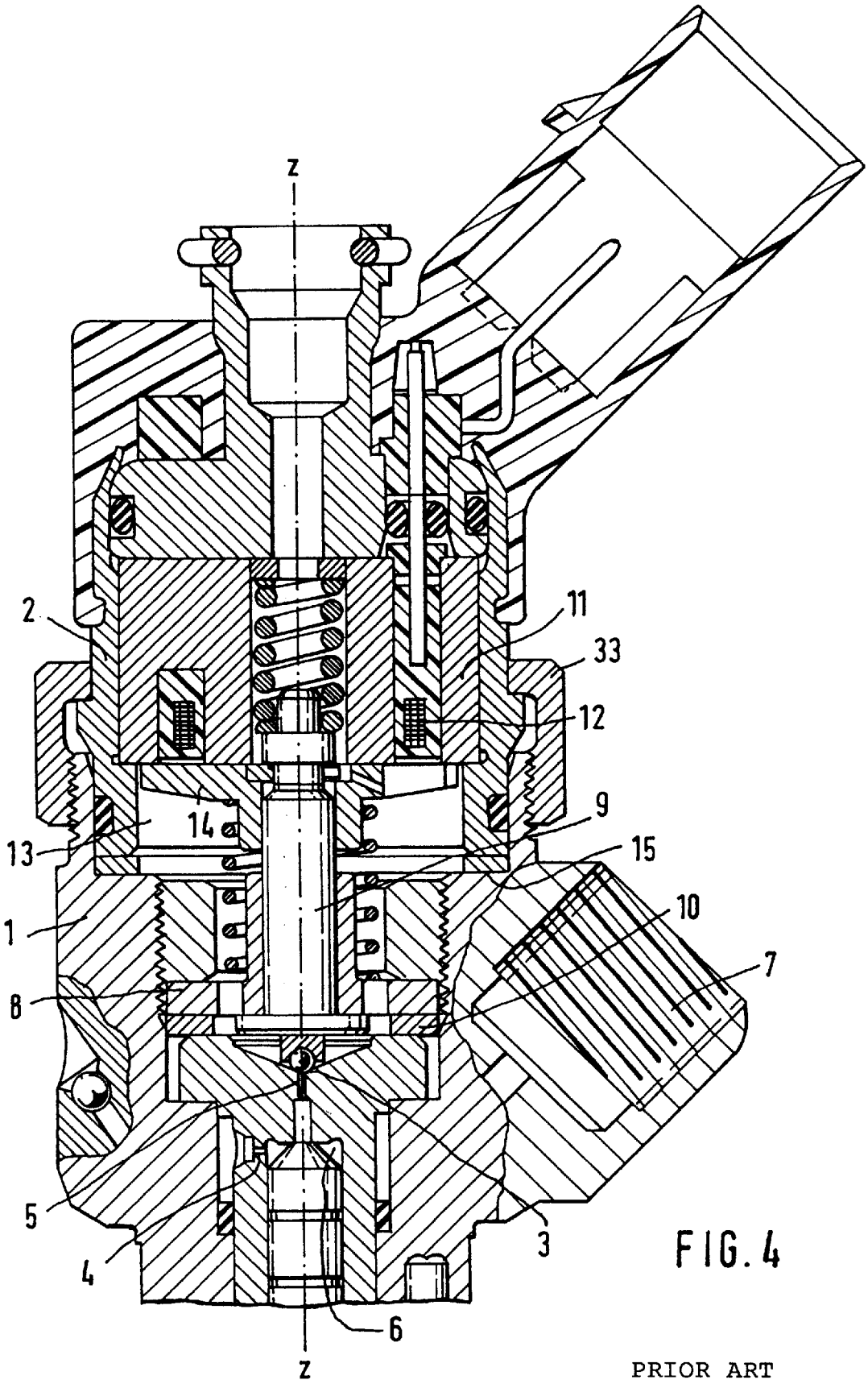
FIG. 4 PRIOR ART
FIG. 4 is an axial section through a known pilot control valve.

FIG. 1 shows the upper part of a fuel injection valve with a pilot control valve of the invention in cross section.

Elements of the pilot control valve that correspond to those of the known pilot control valve described above are identified by the same reference numerals.

The housing of the pilot control valve includes a lower, first housing part 1, which is integrally joined to the injection valve. The first housing part in its upper region forms a cylindrical well, with walls 16 parallel to a longitudinal axis z-z of the valve; a plug-in portion 17 of the second housing part is plugged into these walls in form-locking fashion, so that the two housing parts together define a chamber 13. The chamber communicates with a fuel inlet neck 7 via a first throttle 4, a control chamber 6 of the injection valve, and a second throttle 5; the second throttle 5 discharges at the bottom of a blind bore 18 which extends downward from the bottom of the chamber 13. A continuous bore 19 aligned with the blind bore 18 extends through a magnet core 11 let into the second housing part 2, and it discharges into a pipe neck 20 on the top of the second housing part 2.

A valve closing member 9 is guided in the blind bore 18 substantially without play between an open position and a closed position, in which it rests on the valve seat 3. The valve closing member 9 is made from a needle bearing roller by grinding down or milling a channel 21 in the form of a flat face or a groove. An armature plate 14, which extends substantially over the full cross section of the chamber 13, is secured to the valve closing member 9.

FIG. 2 shows the disposition of the valve closing member 9 and armature plate 14 in perspective. On its surface toward the second housing part, the armature plate has two flat regions 22 and 23 at right angles to the axis z-z; the outer region 22 protrudes past the inner region 23 by approximately d=50 $\mu$m in the direction toward the second housing part. This can be seen most clearly from FIG. 3, which shows the detail marked III in FIG. 1 on a larger scale. The radius of the inner region 23 is equivalent to that of the magnet core 11, which is let into a recess of the second housing part in such a way that its outer face, toward the chamber 13, is flush with the portion 36, radially surrounding it, of the second housing part.

The protrusion distance d thus defines the width of the air gap between the armature plate and the magnet core in the open state of the pilot control valve.

A spiral spring 25 is fastened under pressure in the bore 19, between the valve closing member 9 and a sleeve 24.

Contact prongs for the electrical power supply to a coil of the magnet core 11 extend through the second housing part and protrude from its top in the vicinity of the pipe neck 20. A cap 26 with a through hole for the pipe neck 20 is fitted over the top of the second housing part 2 and locks in detent fashion in an encompassing groove 27 of the wall 16 of the first housing part. A plug connector element 28 integrated with the cap 26 is in conductive contact with the contact prongs 29.

A second cap 30 for connection to a fuel return line can be slipped onto the end of the pipe neck 20 and anchored in an encompassing groove 31.

In a state of repose of the pilot control valve, the spiral spring 25 presses the valve closing member 9 against the valve seat 3, so that the pilot control valve is closed. If the coil of the magnet core is excited electrically, then it exerts a magnetic force of attraction on the armature plate 14, and as a result the closing member 9 lifts from the seat 3. After a distance (see FIG. 3) of approximately 50 $\mu$m, the protruding outer region 22 of the armature plate 14 meets the opposed portion 36 of the second housing part and thus defines the opened position of the pilot control valve. The air gap between the inner region 23 and the magnet core 11 that exists in this situation is important in order to prevent the armature plate 14, after the exciting current is shut off, from continuing to adhere to the magnet core by residual magnetism and thus causing a longer open time of the valve than is desired. The second housing part is therefore of nonmagnetic material.

In the opened state of the valve, fuel flows out of the control chamber 6 through the second throttle 5, first into the lower region of the blind bore 18. Since the valve closing member 9 in the blind bore 18 is guided practically without play, the channel 21 is necessary to allow the fuel flowing in via the throttle 5 to flow out via the chamber 13 and the bore 19.

In the assembly of the valve, it is of great importance that the second housing part be introduced into the well formed by the walls 16 exactly up to a set-point position, which is equivalent to a desired stroke of the valve closing member 9. To that end, it is possible for instance to insert the second housing part 2 into the well up to a depth that is approximately equivalent to the set-point position, in this situation to measure the switching performance of the valve, and optionally to adapt the insertion depth, until the valve exhibits the desired switching performance and thus the set-point position is reached. Once the set-point position has been established, the two housing parts are fixed to one another on their walls, touching one another, that extend parallel to the insertion axis z-z; the fixation is done for instance by caulking, laser welding, induction welding, or other suitable techniques. These techniques, which establish an inseparable connection of the housing parts, can be employed here because, once the setting of the set-point position has been done correctly, there is no need to dismantle the pilot control valve again for readjustment. This fixation is expediently done in the encompassing groove 27, first because this groove is the thinnest and thus the most easily machined region of the walls 16, and second because fixation machining done in the groove leaves behind only hardly visible external traces on the housing of the pilot control valve.

In the assembly, an elastic intermediate ring 34 which is disposed between the upper edge of the walls 16 and a collar 35 of the second housing part may be useful. The thickness of the ring is dimensioned such that when the second housing part is plugged in, just before the suspected set-point position is reached, the upper edge of the walls 16, the ring 34, and the collar 35 come into contact. By pressing the first and second housing parts together, the insertion depth can then be adjusted easily by adjusting a compression force acting on the ring, and thus the set-position can be found in the course of the adjustment of the pilot control valve.

A further step in the assembly of the pilot control valve of the invention is the fixation of the sleeve 24 in the interior of the pipe neck 20. Before the fixation, the force with which the spiral spring 25 presses the valve closing member 9 against its seat 3 can be adjusted, by displacing the sleeve 24 along the axis, in order to optimize the switching performance of the valve in this way. Once the position of the sleeve 24 has been set, the sleeve can be fixed on the pipe neck in the same way as the two housing parts 1 and 2 have been fixed to one another.

In this way, a pilot control valve with a simplified design is obtained, which can be assembled with less effort than previous pilot control valves of this general type and nevertheless has good adjustability.

Numerous modifications and further development of the subject of the invention are possible. For instance, the first housing part 1 may have an insert 32, which receives the blind bore 18 with the valve seat 3 and the throttle 5, and which is made from a material with high mechanical stability under load. For the rest of the housing part 1, an economical and/or easily machined material may be used. The insert 32 can be joined to the rest of the first housing part on the bottom of the well by lock-beading or laser welding.

The control chamber 6 with the throttle 5 can also be inserted as a separate part into this insert, which makes improved precision possible when the throttle is drilled.

The protruding region of the armature plate 14 need not extend over the entire surface facing the portion of the second housing part; it suffices if the armature plate has isolated protrusions whose number and size suffice to keep the desired air gap between the armature plate and magnet core open. The armature plate may be perforated at some points, to facilitate the flow of fuel through it in the direction of the pipe neck 20.

The foregoing relates to preferred exemplary embodiments of the invention, it being understood that other variants and embodiments thereof are possible within the spirit and scope of the invention, the latter being defined by the appended claims.

We claim:

1. A pilot control valve of a fuel injection valve, comprising a first housing part (1) which forms a well with walls (16) parallel to an axis (z-z);

a second housing part (2), with a plug-in portion (17) which is introduced in form-locking fashion into the well up to a set-point position, and the housing parts (1, 2) jointly define a chamber (13), in which a valve closing member (9) is displaceable along the axis (z-z) in the chamber (13) between a closed position, in which it rests on a pilot control valve seat (3), and an open position, and the stroke of the valve closing member (9) between the closed and the open positions is defined by the set-point position; and the plug-in portion (17) is fixed in the set-point position on the walls (16) of the well that are parallel to the axis (z-z).

2. The pilot control valve according to claim 1, in which the set-point position is a position in which the first and second housing parts (1, 2) are displaceable along the axis in both directions counter to one another before the fixation.

3. The pilot control valve according to claim 1, in which the pilot control valve has an intermediate ring (34) which is retained between a collar (35) of the second housing part and the edge of the well.

4. The pilot control valve according to claim 2, in which the pilot control valve has an intermediate ring (34) which is retained between a collar (35) of the second housing part and the edge of the well.

5. The pilot control valve according to claim 1, in which the valve seat (3) is disposed in the first housing part (1).

6. The pilot control valve according to claim 2, in which the valve seat (3) is disposed in the first housing part (1).

7. The pilot control valve according to claim 3, in which the valve seat (3) is disposed in the first housing part (1).

8. The pilot control valve according to claim 5, in which the valve seat (3) is formed on a bottom of a blind bore (18), whose inner walls guide the valve closing member (9) in its displacement substantially without play.

9. The pilot control valve according to claim 8, in which the valve closing member (9) includes a cylindrical body, on whose jacket surface at least one channel (21) for diverting fuel extends from the valve seat (3) in the direction of the axis (z-z).

10. The pilot control valve according to claim 5, in which a spiral spring (24) is fastened axially in a bore (18) of the second housing part (2) between the valve closing member (9) and an abutment, in order to urge the valve closing member (9) in the closing direction.

11. The pilot control valve according to claim 8, in which a spiral spring (24) is fastened axially in a bore (18) of the second housing part (2) between the valve closing member (9) and an abutment, in order to urge the valve closing member (9) in the closing direction.

12. The pilot control valve according to claim 9, in which a spiral spring (24) is fastened axially in a bore (18) of the second housing part (2) between the valve closing member (9) and an abutment, in order to urge the valve closing member (9) in the closing direction.

13. The pilot control valve according to claim 10, in which the abutment is a sleeve (24), which is introduced in form-locking fashion into the bore (19) and axially fixed on the inner walls of the bore.

14. The pilot control valve according to claim 13, in which the bore (19) is lengthened by a pipe neck (20) in a region of the second housing part (2) remote from the plug-in portion (17), and the axial fixation of the sleeve (24) is effected at the level of the pipe neck (20).

15. The pilot control valve according to claim 1, which includes an armature plate (14), which extends transversely to the axis (z-z) and is solidly joined to the valve closing member (9) and by a magnet core (11), facing toward the armature plate (14) for exerting a force on the armature plate (14) for displacing the valve closing member (9), said core is let into the second housing part (2), and a first region (23) of the armature plate faces the magnet core (11) and a second region (22) of the armature plate faces a portion (36) of the second housing part (2), and the portion (36) and the armature plate (14) are shaped so as to keep an air gap (d) between the magnet core (11) and armature plate (14) open when the portion (36) comes into contact with the second region (22) of the armature plate.

16. The pilot control valve according to claim 15, in which the portion (36) protrudes past the surface of the magnet core (11) facing toward the armature plate (14).

17. The pilot control valve according to claim 15, in which the second region (22) of the armature plate (14) protrudes past the first region (23) in the direction toward the magnet core (11).

18. The pilot control valve according to claim 17, in which the portion (36) and the surface of the magnet core (11) facing toward the armature plate (14) are located in the same plane.

19. The pilot control valve according to claim 15, in which the portion (36) annularly surrounds the magnet core 11.

20. The pilot control valve according to claim 1, in which the second housing part (2) is enclosed between the second housing part (1) and a cap (26) locked in detent fashion to the walls (16) of the well.

21. The pilot control valve according to claim 20, in which the cap (26) carries an electric plug connector element (28) for the electrical power supply to a coil of the magnet core 11.

22. A method for assembling a pilot control valve of a fuel injection valve, in which the pilot control valve includes first and a second housing parts (1, 2), the first housing part (1) has a well with walls (16) parallel to an axis, and the second housing part (2) is introduced in form-locking fashion into the well up to a set-point position in order to define a chamber 13 in which a valve closing member (9) is displaceable between a closed position, in which it rests on a pilot control valve seat (3), and an open position, and the stroke of the valve closing member (9) between a closed and an open position is defined by the set-point position, having the following steps:

(a) introducing the second housing part into the well up to the set-point position; and after that, (b) fixing the second housing part (2) to the walls (16) that are parallel to the axis.

23. A method according to claim 22, in which step (a) includes the introduction of the first housing part into a position which is approximately equivalent to the set-point position, and the establishment of the first housing part in the set-point position by measurement of a switching performance of the pilot control valve, and selecting as the set-point position a position in which the pilot control valve exhibits a desired switching performance.

* * * * *